US005640920A

United States Patent [19]

Dorr

[11] Patent Number: 5,640,920

[45] Date of Patent: Jun. 24, 1997

[54] PYRAMID SHAPED MOORING ANCHOR

[76] Inventor: Rodney C. Dorr, R.R. 2, Box 476, Claremont, N.H. 03743

[21] Appl. No.: 664,162

[22] Filed: Jun. 14, 1996

Related U.S. Application Data

[63] Continuation of Ser. No. 420,413, Apr. 12, 1995, abandoned, which is a continuation of Ser. No. 292,261, Aug. 18, 1994, abandoned, which is a continuation of Ser. No. 82,537, Jun. 25, 1993, abandoned, which is a continuation of Ser. No. 718,770, Jun. 21, 1991, abandoned, which is a continuation of Ser. No. 491,037, Apr. 30, 1990, abandoned, which is a continuation of Ser. No. 285,623, Dec. 16, 1988, abandoned.

[51] Int. Cl.[6] ..... B63B 21/24

[52] U.S. Cl. ..... 114/294

[58] Field of Search ..... 114/293, 294, 114/300; 43/44.9, 44.96

[56] References Cited

U.S. PATENT DOCUMENTS

| | | | |
|---|---|---|---|
| 2,023,526 | 12/1935 | Hoberg | 114/300 |
| 2,599,200 | 6/1952 | Rogers | 114/294 |
| 3,187,705 | 6/1965 | Costello et al. | 114/294 |
| 3,204,364 | 9/1965 | Beers | 43/44.96 |

*Primary Examiner*—Jesus D. Sotelo
*Attorney, Agent, or Firm*—Michael J. Weins

[57] ABSTRACT

The present invention is an anchor formed by combining a pyramid with a shaft and an eye. The pyramid has a base and an apex displaced from the base by an apex separation distance D and projecting onto a central region of the base. The shaft, having a shaft length L, is mounted substantially normal to the base of the pyramid with a first shaft end attached to the base of the pyramid and substantially centered thereon. It is preferred that the shaft length L be less than or about equal to the apex separation distance D. The eye is formed on the second shaft end of the shaft. Preferably, the pyramid is four-sided and has a substantially square base with edges having a nominal edge length l. It is further preferred for the apex separation distance D to be about ½ of the edge length l.

6 Claims, 2 Drawing Sheets

PYRAMID SHAPED MOORING ANCHOR

This application is a continuation of Ser. No. 08/420,413, filed Apr. 12, 95 now abandoned; which is a continuation of Ser. No. 08/292,261, filed Aug. 18, 94, now abandoned; which was a continuation of Ser. No. 08/082,537, filed Jun. 25, 93, now abandoned; which was a continuation of Ser. No. 07/718,770, filed Jun. 21, 91, now abandoned; which was a continuation of Ser. No. 07/491,037, filed Apr. 30, 90, now abandoned; which was a continuation of Ser. No. 07/285,623, filed Dec. 16, 88, now abandoned.

FIELD OF THE INVENTION

This invention relates to an anchor for securing watercraft such as boats, and has particular utility as a mooring anchor.

BACKGROUND OF THE INVENTION

Mooring systems provide a permanent anchorage for a watercraft in a body of water. The system is designed for the watercraft to be attached to it for long periods of time when not in use. A mooring system has an anchor submerged in the body of water and affixed to the bottom. A chain is attached to the anchor and to a buoy. A line from the watercraft to the buoy secures the watercraft to the mooring system.

Mooring anchors are distinguished from conventional anchors, such as kedging anchors, in that conventional anchors are intended to provide temporary anchorages, and therefore are designed to resist lateral forces from one direction but readily disengage from the bottom when subjected to vertical pulls, while mooring anchors are designed to resist lateral forces from any direction as well as vertical forces so as to remain in place at all times.

A mooring anchor should remain engaged with the bottom even when the watercraft attached thereto is subjected to severe forces, such as hurricane winds, even when storm surges increase the local water depth, thereby creating a greater vertical component of pull. Failure to remain engaged results in the mooring dragging, and the watercraft attached thereto may incur severe damage due to collision with other watercraft, rocks, reefs, or the shore.

Current mooring systems use anchors which are either installed or self-seating. Classically, the self-seating anchors used for securing the mooring system have been either large blocks of stone or concrete, which rest on the bottom of the body of water, or mushroom-shaped mooring anchors which partially bury in the bottom of the body of water after a period of time. Blocks rely largely on their weight to prevent the mooring from dragging, and lose much of their effective weight when submerged due to buoyant forces, and consequently must be very massive, making them difficult to transport and install.

Mushroom-shaped anchors, on the other hand, can be smaller as they are intended to bury themselves into the bottom to provide resistance to dragging. However, mushroom anchors are dependent on ideal bottom conditions and need to be tipped on their edges to imbed. Even when tipped on their edges, mushrooms frequently fail to bury adequately. Additionally, the traditional mushroom anchor has a long shank which, when the mushroom is inadequately buried, presents a risk of penetrating the hull or damaging the propeller of the watercraft, particularly when used in waters where the tidal range is large. The long shank also can result in the anchor chain wrapping around the shank, reducing the holding power of the mushroom by shortening the effective length of the chain and thereby increasing the vertical component of force applied to the anchor. Because of the long shank and the hollow mushroom shape of the base, mushroom anchors are frequently fabricated in two parts, with the shank welded to the base. This fabrication complicates the manufacture and can result in the weld rusting out. Extensive damage to watercraft which have been moored with classical mushroom anchors during hurricanes indicates a need for an improved self-seating anchor.

Thus there is a need for a self-seating anchor which can be readily transported and will reliably imbed itself into the bottom under a wide range of bottom conditions, and which does not present a risk of damage to the watercraft when used in areas of large tidal range. There is also a need for an anchor which is readily fabricated by casting.

SUMMARY OF THE INVENTION

The present invention provides an anchor having particular utility as a mooring anchor. The anchor is formed by combining a pyramid with a shaft and an eye.

The pyramid has a base and an apex displaced from the base by an apex separation distance D. The apex is positioned such that projection of the apex onto the base is substantially centered thereon.

The shaft, having a shaft length L, terminates in a first shaft end and a second shaft end. The shaft is mounted substantially normal to the base of the pyramid with the first shaft end attached to the base of the pyramid and substantially centered thereon. It is preferred that the shaft length L be less than or about equal to the apex separation distance D. It is further preferred that the shaft be joined to the base with a filleted junction.

The eye is formed on the second shaft end of the shaft. The size of the eye should be sufficiently large to accommodate a shackle suitable to the size of the chain to be used in accordance with the size of the watercraft to be moored.

Preferably, the pyramid is four-sided and has a substantially square base with edges having a nominal edge length l It is further preferred for the apex separation distance D to be about ½ of the edge length l, which will provide an angle θ between the base and the sides of about 45°.

BEST MODE OF CARRYING THE INVENTION INTO PRACTICE

Figure 1:
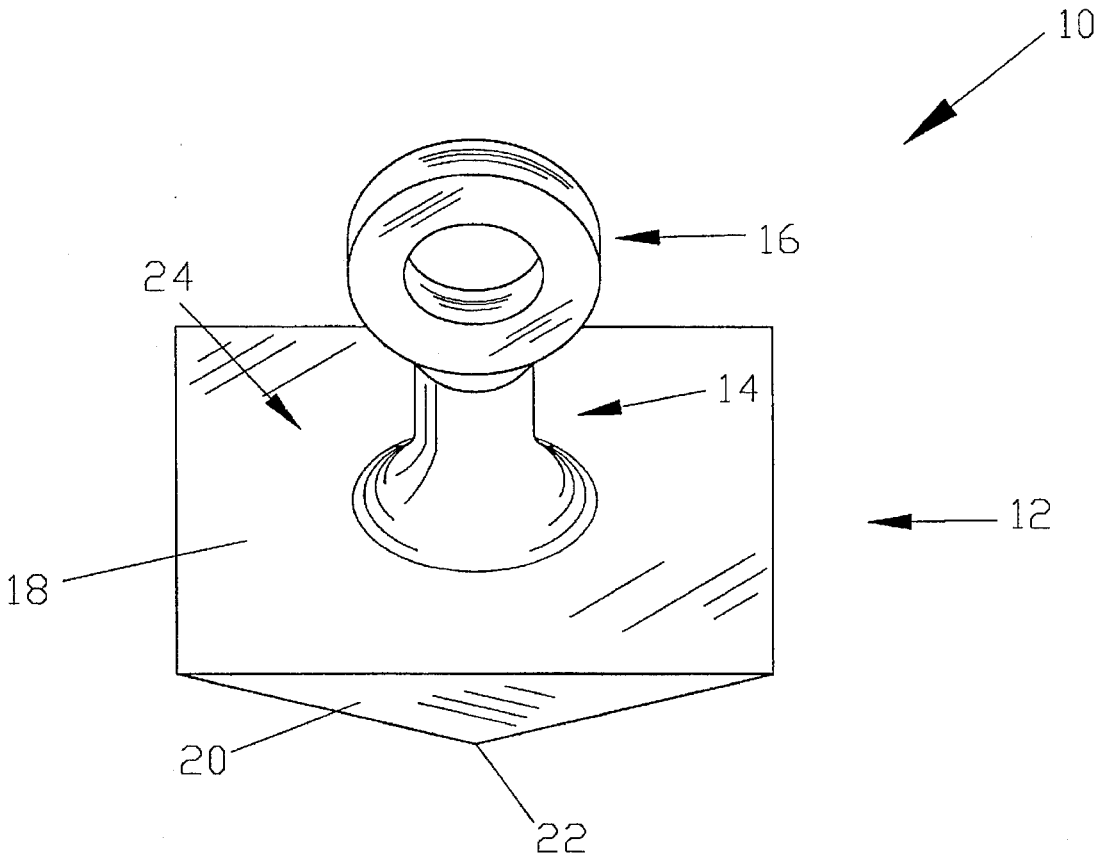
FIG. 1 is an isometric view of an embodiment of an anchor of the present invention which has a square base.
Figure 2:
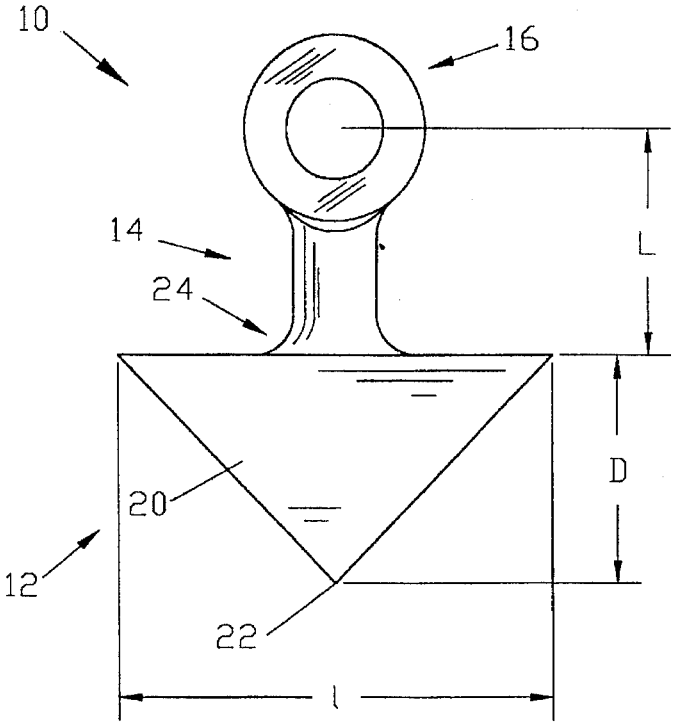
FIGS. 2 and 3 are elevation views of the embodiment illustrated in FIG. 1.
Figure 3:
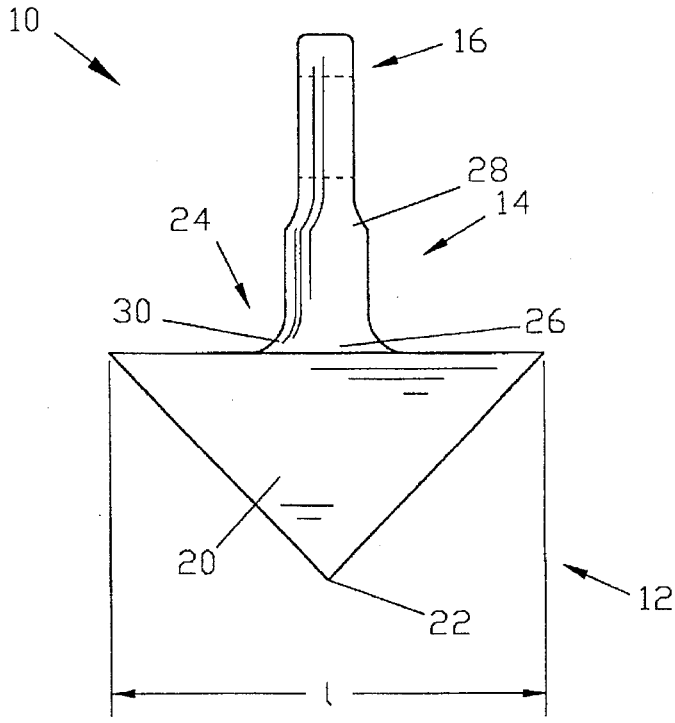

FIGS. 1 through 3 show an anchor 10 of the present invention formed by a pyramid 12, a shaft 14, and an eye 16.

The pyramid 12 has an essentially square base 18, which has edges having nominal edge lengths l. The pyramid 12 is further bounded by triangular sides 20 which terminate in an apex 22. The triangular sides 20 are isosceles triangles which results in the apex 22 being positioned such that it projects onto a central region 24 of the base 18. The apex 22 is separated from the base 18 by an apex separation distance D. It is preferred that the apex separation distance D is approximately ½ the edge length l, resulting in an angle θ between the base 18 and the triangular sides 20 which is about 45°.

The shaft 14, having a shaft length L, terminates in a first shaft end 26 and a second shaft end 28 having the eye 16 formed thereon. The shaft 14 is mounted substantially normal to the base 18 having the first shaft end 26 attached to the central region 24 of the base 18.

The length L of the shaft 14 is approximately the same as the apex separation distance D, thereby providing an attachment point for an anchor chain which is at a distance from the base 18 of about the separation between the apex 22 and the base 18. This short shank length L reduces the chance of damage to watercraft hitting the shank, and is particularly useful when the anchor 10 is employed in locations where the tidal range is great. Additionally, such a length reduces the possibility of the anchor chain wrapping around the shaft 14. Wrapping of the anchor chain around the shaft 14 would reduce the effective length of the anchor chain and thereby increase the vertical component of the force applied to the anchor 10, thus reducing the holding power of the anchor 10.

The shaft 14 and the base 18 preferably join in a filleted junction 30. The filleted junction 30 is well suited for fabricating the anchor 10 by casting. Casting is the preferred method for fabricating the anchor since it allows a metal anchor to be formed in its final shape without machining. This results in an anchor which will be less prone to having the shaft-base junction rust out and allows the anchor to be readily fabricated in a variety of sizes according to the intended use.

The eye 16 is formed as an integral part of the shaft second end 28 and is sized to allow attachment of a shackle for connecting the anchor 10 to a chain. The formation of the eye 16 as an integral part of the shaft second end 28 further facilitates fabricating the anchor 10 by casting.

The pyramid shaped anchor 10 readily imbeds into the bottom. When dropped overboard, the anchor 10 falls such that the apex 22 contacts the bottom first. The loading of the weight of the anchor 10 onto the apex 22 allows the anchor 10 to penetrate deeply into the bottom.

When subjected to lateral pulling on the eye 16, the anchor 10 will tip from an upright position onto one of the sides 20 or corners of the pyramid 12. In either case, the angle presented to the bottom will cause the pyramid 12 to dig into the bottom in response to the lateral pull, thereby further burying the pyramid 12 of the anchor 10.

While the novel features of the present invention have been described in terms of a particular embodiment and preferred application, it should be appreciated by one skilled in the art that substitution of materials and modification of details obviously can be made without departing from the spirit of the invention.

What I claim is:

1. A marine anchor comprising:

a pyramid having a base and an apex, said apex being positioned such that its projection onto said base is substantially centered thereon and said apex being displaced from said base by an apex separation distance D; and a shaft having a shaft length L and terminating in a first shaft end and a second shaft end, said shaft being mounted substantially normal to said base with said first shaft end being attached to the base and substantially centered thereon, wherein said shaft length L is less than or about equal to said apex separation distance D; and an eye formed on said second shaft end of said shaft.

2. The anchor of claim 1 wherein said anchor is a mooring anchor and said base is substantially square having nominal edge lengths l.

3. The mooring anchor of claim 2 wherein said shaft joins said base with a filleted junction.

4. The mooring anchor of claim 3 wherein said apex separation distance D is about ½ of said edge length l.

5. The anchor of claim 1 wherein said pyramid is a solid metal structure.

6. The anchor of claim 5 wherein said anchor is a cast structure.

* * * * *